US007039331B2

(12) United States Patent
Yoshida

(10) Patent No.: US 7,039,331 B2
(45) Date of Patent: May 2, 2006

(54) IMAGE FORMING APPARATUS

(75) Inventor: Narutaka Yoshida, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 186 days.

(21) Appl. No.: 10/773,269

(22) Filed: Feb. 9, 2004

(65) Prior Publication Data

US 2005/0084274 A1 Apr. 21, 2005

(30) Foreign Application Priority Data

Oct. 20, 2003 (JP) ..... 2003-359004 A

(51) Int. Cl.
*G03G 15/00* (2006.01)
*G03G 15/16* (2006.01)

(52) U.S. Cl. ..... 399/44; 399/66; 399/67; 399/308

(58) Field of Classification Search ..... 399/43, 399/44, 66, 67, 162, 302, 303, 308
See application file for complete search history.

(56) References Cited

U.S. PATENT DOCUMENTS 5,907,741 A * 5/1999 Matsuzawa et al. ..... 399/44
2003/0072578 A1* 4/2003 Boothe et al. ..... 399/44

FOREIGN PATENT DOCUMENTS

JP 5-45959 2/1993
JP 07-248697 A * 9/1995
JP 2000-136855 5/2000
JP 2001-175139 6/2001

* cited by examiner

*Primary Examiner*—Sophia S. Chen
(74) *Attorney, Agent, or Firm*—Morrison & Foerster LLP

(57) ABSTRACT

To provide an image forming apparatus that prevents generation of image noise by recovering a movable member having flexibility from creep deformation. The image forming apparatus for forming images on a recording medium includes a movable member having flexibility, a detection section for detecting temperature of the movable member directly, a storage section for storing the temperature detected by the detection section when the apparatus is powered off, and a control section for changing a duration of time during which the movable member is in a preparatory operation corresponding to the detected temperature read from the storage section when the apparatus is powered on.

20 Claims, 7 Drawing Sheets

IMAGE FORMING APPARATUS

RELATED APPLICATION

This application is based on Japanese Patent Application No. 2003-359004, the content of which is incorporated herein by reference.

BACKGROUND OF THE INVENTION

The present invention relates to an image forming apparatus capable of preventing generation of image noise by making recovery from creep deformation of movable members having flexibility such as intermediate transfer belts for use in copying machines and printing machines.

In image forming apparatuses such as copying machines and printing machines, movable members having flexibility such as intermediate transfer belts have conventionally been used. Such movable members possibly suffer creep that is the increase of a strain with a lapse of time under the action of constant external force. The creep has dependence on curvature deformation degree, temperature, curvature deformation state retention time, and material properties of the movable members. Accordingly, in order to prevent the creep of the movable members, improvement of their materials are generally conducted, and if that measure alone is not sufficient, made are such attempts as decreasing the deformation degree of the movable members and/or controlling temperature rise thereof.

However, the trend of image forming apparatuses in recent years is toward downsizing, and so a space inside the apparatus becomes small. Consequently, the movable members set in the apparatus are often disposed in the state of having a high deformation degree, which is counted as a disadvantage with respect to creep. For example, a roller which supports an intermediate transfer belt that is a movable member having flexibility from therewithin is, for example, 30 mm in diameter in the case of a conventional model, whereas the roller is, for example, 24 mm in diameter in the case of a recent model. Thus, the decreasing the diameter of the roller achieves space saving, which, however, causes the intermediate transfer belt to be supported in the state of being curvature with a curvature larger than a conventional one. With such a large curvature, creep tends to be generated in a portion of the intermediate transfer belt supported in the state of being curvature-deformed under the action of predefined tension, and when creep deformation is increased, image noise is generated due to that portion.

Generally, the creep is highly dependent on temperature, so that the inside of the apparatus and the intermediate transfer belt are cooled by means of a fan in order to cope with the creep while maintaining space-saving achievement. However, the cooling fan does not function when the apparatus is powered off, which turns out to increase the inside temperature of the apparatus, bringing out an disadvantage with respect to the creep generated in the movable members having flexibility. Moreover, the apparatus is possibly left under high temperature environments with its power supply cut off for a long period of time while it is transported or stored.

SUMMARY OF THE INVENTION

Accordingly, an object of the present invention is to provide an image forming apparatus that prevents generation of image noise in such a way that if creep deformation is generated in a movable member having flexibility due to the apparatus being in a high-temperature state while it is being powered-off, the movable member is recovered from the creep deformation when the apparatus is powered on again, before image forming operation is performed, and to provide a control method thereof.

In order to accomplish the aforementioned object, one aspect of the present invention is an image forming apparatus for forming images on a recording medium, comprising:

a movable member having flexibility;

a detection section for detecting a temperature of the movable member directly or indirectly; and a storage section for storing the temperature detected by the detection section when the apparatus is powered off; and a control section for changing a duration of time during which the movable member is in a preparatory operation corresponding to the detected temperature read from the storage section when the apparatus is powered on.

In the above-configured image forming apparatus of the present invention, a duration of time during which the flexible movable member is in a preparatory operation is controlled to be changed according to the temperature of the movable member when the apparatus is powered off, so that if creep deformation is generated in the movable member having flexibility due to the apparatus being in a high-temperature state while it is being powered-off, the movable member is recovered from the creep deformation while the movable member is in a preparatory operation for a duration of time longer than that in normal stabilization control. This makes it possible to prevent image noise attributed to creep deformation of the movable member.

In the image forming apparatus of the present invention, the control section may put the movable member in a preparatory operation for first predefined time when the detected temperature read from the storage section is below a specified temperature, and may put the movable member in a preparatory operation for second predefined time that is longer than the first predefined time when the detected temperature is equal to or above the specified temperature.

In the image forming apparatus of the present invention, the control section may put the movable member in a preparatory operation for third predefined time that is longer than the second predefined time when the detected temperature does not exist in the storage section.

Further in the image forming apparatus of the present invention, the control section may further change a duration of time during which the movable member is put in a preparatory operation according to a lapse of time from power-off to repower-on of the apparatus. In this case, the lapse of time may be obtained from a clock backed up with a battery by the control section.

Further in the image forming apparatus of the present invention, the detection section may detect the temperature of the movable member indirectly from an inside temperature of the apparatus, may detect the temperature of the movable member indirectly from an image printing mode, or may detect the temperature of the movable member indirectly from a temperature of a member other than the movable member.

Further in the image forming apparatus of the present invention, the movable member may be an endless belt hung over at least two rollers. In this case, the endless belt may be an intermediate transfer belt or a fixing belt.

Further in the image forming apparatus of the present invention, the movable member may be an electrically-charging member.

In order to accomplish the above object, another aspect of the present invention is a method for controlling an image forming apparatus which includes a movable member having flexibility, comprising:

a step 1 for detecting a temperature of the movable member directly or indirectly when the image forming apparatus is powered off; and a step 2 for changing a duration of time during which the movable member is put in a preparatory operation when the image forming apparatus is powered on according to the temperature detected in the step 1.

In the control method of the present invention, in the step 2, the movable member may be put in a preparatory operation for first predefined time when the detected temperature is below a specified temperature, and the movable member may be put in a preparatory operation for second predefined time that is longer than the first predefined time when the detected temperature is equal to or above the specified temperature.

Further in the control method of the present invention, the step 1 may further include a step for storing data relating to the detected temperature in a storage section, and in the step 2, the movable member may be put in a preparatory operation for third predefined time that is longer than the second predefined time when the data does not exist in the storage section.

Further in the control method of the present invention, further in the step 2, a duration of time during which the movable member is put in a preparatory operation may be changed corresponding to a lapse of time from power-off to repower-on of the image forming apparatus.

Further in the control method of the present invention, the movable member may be an endless belt hung over at least two rollers. In this case, the endless belt may be an intermediate transfer belt or a fixing belt.

Further in the control method of the present invention, the movable member may be an electrically-charging member.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENTS

Figure 1:
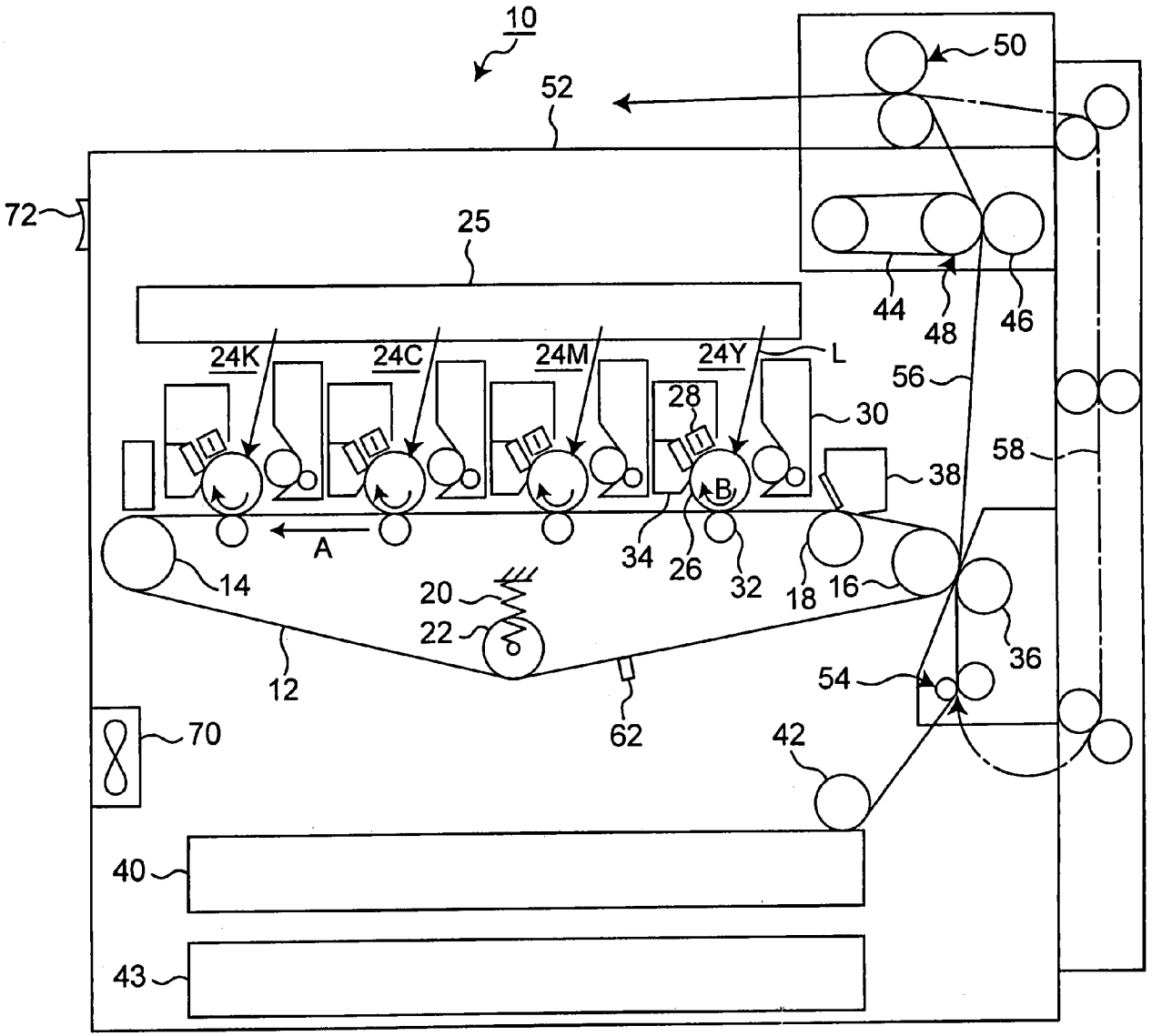
FIG. 1 is an overall schematic diagram showing an image forming apparatus.

FIG. 1 shows an overall configuration of an image forming apparatus 10 in one embodiment of the present invention. The image forming apparatus 10 is equipped with an intermediate transfer belt 12 that is an movable member having flexibility situated in an almost center section of the apparatus. The intermediate transfer belt 12 is composed of an endless belt made of a thin resin film.

The intermediate transfer belt 12 is hung over three support rollers 14, 16, 18 that are provided inside of the intermediate transfer belt 12. A tension roller 22 pressed by a spring 20 is in press-contact with the intermediate transfer belt 12 from inside, so that the intermediate transfer belt 12 is under the action of a specified tension (i.e., external force). Thus, the intermediate transfer belt 12 is in an inoperative state with the roller-supported portions being curved under the action of the specified tension when image forming is not under operation. Further, the support roller 14 is a driving roller that is interlocked with an unshown motor and driven so as to rotate, and when the support roller 14 is driven so as to rotate, the intermediate transfer belt 12 is rotated in an arrow A direction. Furthermore, an intermediate transfer belt temperature sensor (detection section) 62 is disposed in contact with or in the vicinity of the intermediate transfer belt 12 for directly detecting the temperature thereof. It is to be noted that the number of the support rollers for the intermediate transfer belt 12 may be at least not less than two.

On the intermediate transfer belt 12, there are disposed four print units 24Y, 24M, 24C, 24K in order alongside each other. These four print units 24Y, 24M, 24C, 24K respectively correspond to a yellow toner (Y), a magenta toner (M), a cyan toner (C), and a black toner (K). With respect to the moving direction of the intermediate transfer belt 12, the print unit 24Y for yellow toner is located on the most upstream side, and the print unit 24K for black toner is located on the most downstream side. Above each of the print units 24Y, 24M, 24C, 24K, a laser unit 25 is disposed.

Each of the print units 24Y, 24M, 24C, 24K has an identical configuration and includes a drum-shaped photo conductor 26 with a thin film made of an Organic Photo Conductor (OPC) material being formed on the surface thereof. The photo conductor 26 is driven so as to rotate in an arrow B direction by an unshown motor. Each of the print units 24Y, 24M, 24C, 24K is disposed so that each of their photo conductors 26 is in contact with the intermediate transfer belt 12.

Around the photo conductor 26, there are disposed, in an order along the rotating direction of the photo conductor 26, an electrical charger 28 for equally electrifying the surface of the photo conductor 26, a developing unit 30 for developing with a toner an electrostatic latent image composed of a potential-attenuated portion formed on the surface of the equally electrified photo conductor 26 by exposing it to light from the laser unit 25 to produce a toner image, a primary transfer roller 32 disposed with the intermediate transfer belt 12 being interposed between the primary transfer roller 32 and the photo conductor 26 for primarily transferring the toner image formed on the photo conductor 26 onto the intermediate transfer belt 12, and a cleaner 34 for scraping and collecting a residual toner on the surface of the photo conductor 26 after primary transfer is conducted. It is to be noted that the electrically-charging member for equally electrifying the surface of the photo conductor 26 may be a flexible electrically-charging brush or a flexible electrically-charging roller, which is in press-contact with the surface of the photo conductor 26 and allows rotative drive.

Further, a secondary transfer roller 36 is disposed so as to be in contact with a portion of the intermediate transfer belt 12 supported by the support roller 16. The secondary transfer roller 36 is for conducting secondary transfer of a toner image, that was primarily transferred onto the intermediate transfer belt 12, onto a recording medium such as paper.

Further, on the downstream side of the secondary transfer roller 36 with respect to the moving direction of the intermediate transfer belt 12, a cleaner 38 is disposed. The cleaner 38 is for scraping and collecting residual toners on the intermediate transfer belt 12 after secondary transfer is conducted.

On a lower portion in the image forming apparatus 10, a paper feed cassette 40 is disposed. Recording media such as paper stacked and housed in the paper feed cassette 40 are sent out sheet by sheet by a paper feed roller 42. Below the paper feed cassette 40, disposed is a power supply 43 for supplying power to each section of the image forming apparatus 10.

On an upper portion in the image forming apparatus 10, there are disposed a fixing device 48 composed of an endless fixing belt 44 hung over two rollers and a pressure roller 46 so as to form a fixing nip between the fixing belt 44 and the pressure roller 46, and a discharge roller 50 composed of a pair of rollers. Moreover, the upper surface of the image forming apparatus 10 forms a discharged paper tray 52.

Paper sent out from the paper feed cassette 40 travels, from the paper feed cassette 40, through a nip section between a pair of conveyer rollers 54, a nip section between the intermediate transfer belt 12 and the secondary transfer roller 36, the fixing nip of the fixing device 48, and a nip section of the discharge roller 50, and is conveyed along a conveyer route 56 extending in an approximately vertical direction.

On a lateral side of the image forming apparatus 10, a circulation route 58 shown with a chain line is provided. A one-side printed sheet of paper switched back by the discharge roller 50 is then conveyed downward through the circulation route 58 to a pair of the conveyer rollers 54, and is again conveyed upward through the conveyer route 56 with its unprinted side facing the side of the intermediate transfer belt 12.

On the inner side face of the main body of the image forming apparatus 10, there is provided a fan 70 for suppressing temperature rise inside the apparatus. On the outer side face of the main body of the image forming apparatus 10, there is provided a main switch 72 for switching on/off the power of the apparatus. By turning off the main switch 72, power supply from the power supply 43 to each section of the apparatus is cut off.

Figure 2:
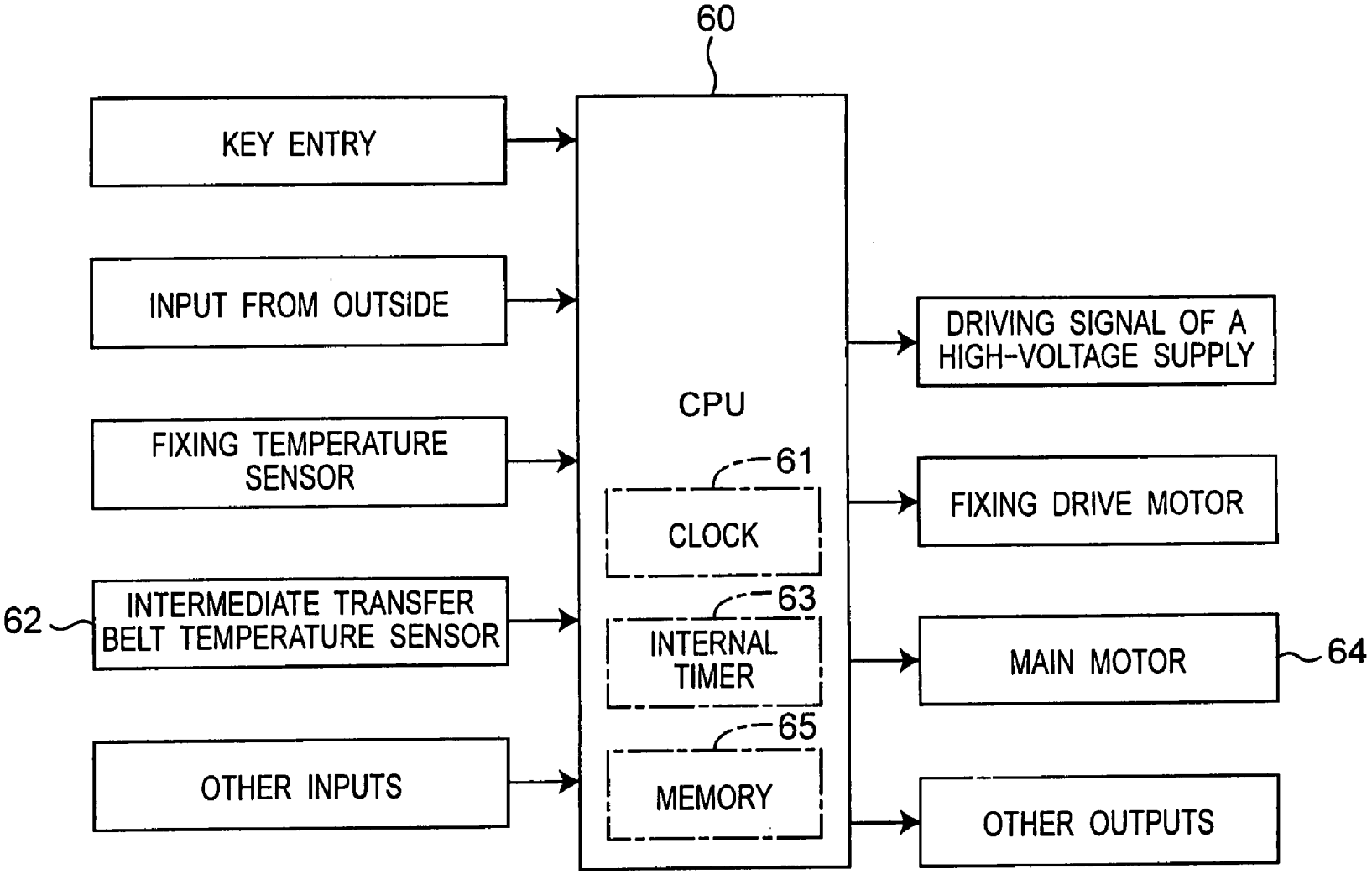
FIG. 2 is a block diagram showing a control section.

As shown in FIG. 2, the image forming apparatus 10 includes a control section 60 composed mainly of a CPU. The control portion 60 incorporates a clock 61, an internal timer 63, and a memory (storage section) 65. The clock 61 is backed up with an unshown battery so as to tick down even if the main switch 72 is switched off.

The control section 60 receives a key entry from an unshown operation panel, an input from outside of the apparatus, an input of detected temperature from a fixing temperature sensor, an input of detected temperature from the intermediate transfer belt temperature sensor 62, as well as other inputs. The control section 60 also outputs a driving signal of a high-voltage supply 43, a driving signal of a fixing drive motor for driving the fixing device 48, a driving signal of a main motor 64 for driving the intermediate transfer belt 12 and each of the print units 24Y, 24M, 24C, 24K, as well as other output signals. Moreover, the control portion 60, as described later, controls so that the intermediate transfer belt 12 is put in a preparatory operation for predefined time that is longer than that in normal stabilization control under predefined conditions.

Description will be now given of the operation and control of the above-configured image forming apparatus 10.

Upon switch-on of the main switch 72, the control portion 60 first puts each section of the apparatus in a preparatory operation for predefined time for stabilization control. In normal stabilization control, the intermediate transfer belt 12 is put in a preparatory rotating operation for 50 seconds for example. Then, upon reception of a printing signal from the outside, the control portion 60 operates the intermediate transfer belt 12 and the print units 24Y, 24M, 24C, 24K to start image forming operation.

In the case of a full color image, four print units 24Y, 24M, 24C, 24K are each driven. In each of the print units 24Y, 24M, 24C, 24K, the surface of the photo conductor 26 that is driven so as to rotate in an arrow B direction is equally electrified by the electrical charger 28. Then, the surface of the equally electrified photo conductor 26 is exposed to a laser beam L radiated from the laser unit 25, by which a potential of the exposed portion is attenuated, and therefore an electrostatic latent image is formed.

Then, the electrostatic latent image formed on the surface of each photo conductor 26 is developed with a toner by the developing unit 30 into a toner image. The toner image formed on the surface of the photo conductor 26 is primarily transferred onto the intermediate transfer belt 12 by the electric action of the primary transfer roller 32. Four toner images formed respectively in the print units 24Y, 24M, 24C, 24K are primarily transferred on the intermediate transfer belt 12 in the state of being superimposed on one another. A residual toner on the surface of each photo conductor 26 after the primary transfer is collected by the cleaner 34.

In the case of a monochrome image, only the print unit 24K is activated and therefore only a black toner image is transferred onto the intermediate transfer belt 12.

The toner image transferred on the intermediate transfer belt 12 is moved toward a section facing the secondary transfer roller 36 as the intermediate transfer belt 12 is rotated. There, under the electric action of the secondary transfer roller 36, the toner image is secondarily transferred onto a sheet of paper conveyed from the paper feed cassette 40. Residual toners on the intermediate transfer belt 12 after the secondary transfer are collected by the cleaner 38.

The sheet of paper onto which the toner image was transferred is continued to be conveyed upward through the conveyer route 56, and when the paper passes the fixing nip of the fixing device 48, the toner image is fixed on the paper. After that, the paper is discharged to the discharged paper tray 52 through the discharge roller 50.

In the case of two-side printing, a one-side printed sheet of paper is switched back by the discharge roller 50, sent to the circulation route 58, conveyed again to the conveyer route 56 after traveling the circulation route 58, and after a toner image is transferred onto and fixed on an unprinted side of the paper, the paper is discharged to the discharged paper tray 52 from the discharge roller 50.

In the image forming operations as described above, each component part needs to maintain its predefined shape for proper functioning of respective processes. In the case of the intermediate transfer belt 12 for example, the intermediate transfer belt 12 is, for example, a thin-film endless belt made of resin that consists of a compound of polycarbonate and polybutylene terephthalate. As shown in FIG. 1, the intermediate transfer belt 12 is supported by three support rollers 14, 16, 18, and a tension is applied to the intermediate transfer belt 12 by a tension roller 22 so that the intermediate transfer belt 12 is in close contact with each of the support rollers 14, 16, 18. The intermediate transfer belt 12, which performs rotative operation for image forming operation while the tension is applied thereto, is retained in an inoperative state during standby when image forming is not operated.

Though no problem is seen under general environment, some users switch off the main switch 72 after completion of a series of printing jobs in actuality. Generally, heat is exhausted by the fan 70 so as to suppress temperature rise inside the apparatus. However, if the power is turned off, the fan 70 is stopped either, so that heat may be trapped inside the apparatus, leaving the intermediate transfer belt 12 in a high-temperature state for a long period of time.

If the intermediate transfer belt 12 is left at high temperature for a long period of time as described above, a creep deformation is generated on the intermediate transfer belt 12, and more particularly, the creep deformation tends to be generated in the portions of the intermediate transfer belt 12 supported by the support rollers 14, 16, 18 in the state of being curved in the action of an external force, i.e., a tension. Conventionally, the support rollers 14, 16, 18 have been, for example, 30 mm in diameter and therefore stress exerted to the intermediate transfer belt 12 has been relatively small. However, with recent models, smaller support rollers 14, 16, 18 whose diameter are, for example, 24 mm are used, so that a curvature of the portions of the intermediate transfer belt 12 supported by these support rollers 14, 16, 18 is larger than before, which is counted as an disadvantage with respect to the creep deformation.

When a creep deformation is generated in the portions of the intermediate transfer belt supported by the support rollers 14, 16, 18, the swollenly curved-deformation state remains, and therefore the contact of the portions with the photo conductors 26 is deteriorated, hindering appropriate transfer of toner images on the photo conductors 26 onto the intermediate transfer belt 12. More particularly, in a portion of the intermediate transfer belt with a creep deformation in an arched shape, space is generated between the portion and the photo conductor 26, which makes a part of the toner image on the photo conductor 26 difficult to be transferred onto the intermediate transfer belt, thereby causing image noise that looks like partial dropouts or density degradation. If the creep deformation is small, the intermediate transfer belt 12 can still comes into contact with the surface of the photo conductor 26. However, if the creep deformation is large, the image noise as described above is generated. Therefore, the creep deformation of the intermediate transfer belt 12 should be restrained as much as possible for prevention of the image noise.

Figure 3:
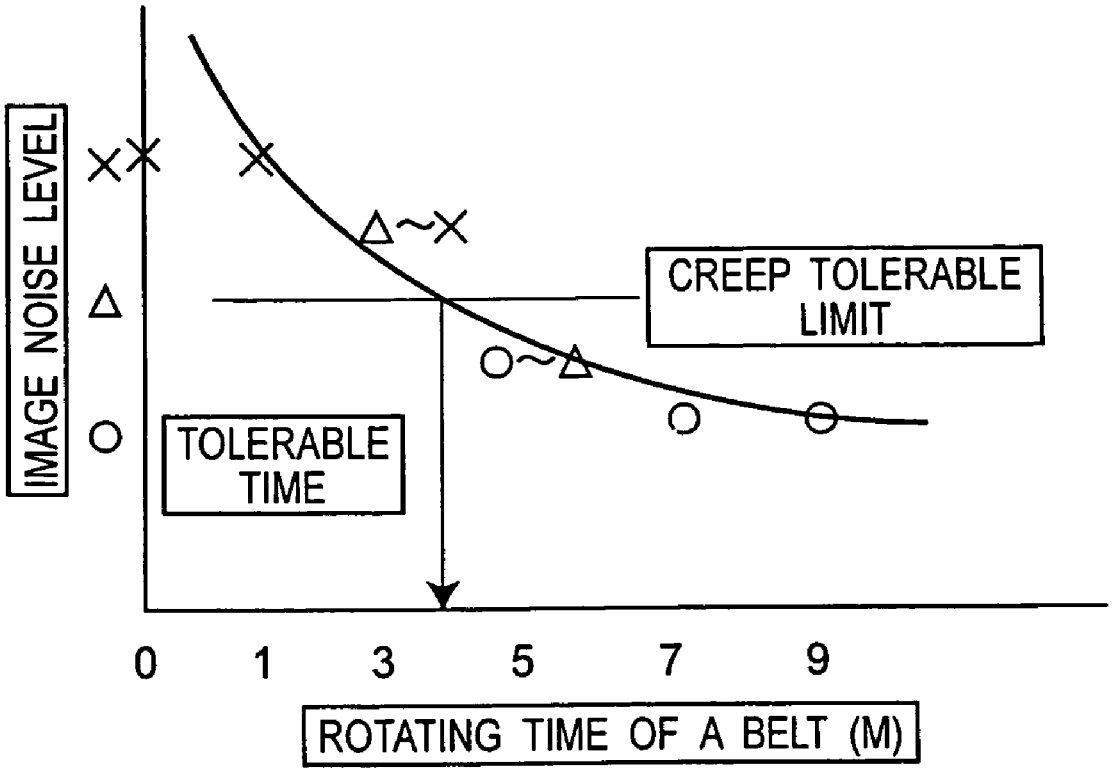
FIG. 3 is a graph view showing the relation between rotating time of a belt and image noise level.

There is a phenomenon that even if a creep deformation portion in an arched shape is generated on the intermediate transfer belt 12, a release force so applied as to extend the arched deformation portion recovers the portion from the creep deformation. FIG. 3 graphs out an experimental result regarding the relation between rotating time of the intermediate transfer belt 12 and image noise level. In this experiment, after left under the environment of 50° C. for 72 hours, the intermediate transfer belt 12 was rotated so as to conduct image forming, and a resultant image noise level was checked. With respect to image noise level, since density degradation is seen in a part of an image which is corresponding to a portion of the intermediate transfer belt 12 with a creep deformation, the degradation level of density was rated into 3 categories: O (tolerable), Δ (tolerable limit), and x (intolerable) by visual inspection.

As shown in FIG. 3, as the rotating time of the intermediate transfer belt 12 increases, the image noise level is recovered to reach the tolerable range. More particularly, if the power is cut off in a high-temperature state, the intermediate transfer belt 12 is put in a preparatory rotating operation for predefined time, that is longer than rotating time in general stabilization control, at the time of next power-on, so that a portion of the intermediate transfer belt 12 with a creep deformation in an arched shape is recovered to its straightened state with a release force applied thereto, by which generation of image noise is prevented.

Accordingly, in the image forming apparatus 10 in the present embodiment, the intermediate transfer belt 12 is recovered from the creep deformation by utilizing this phenomenon so as to prevent generation of image noise in the case where power is turned on again after the power is turned off in a high-temperature state.

Figure 4:
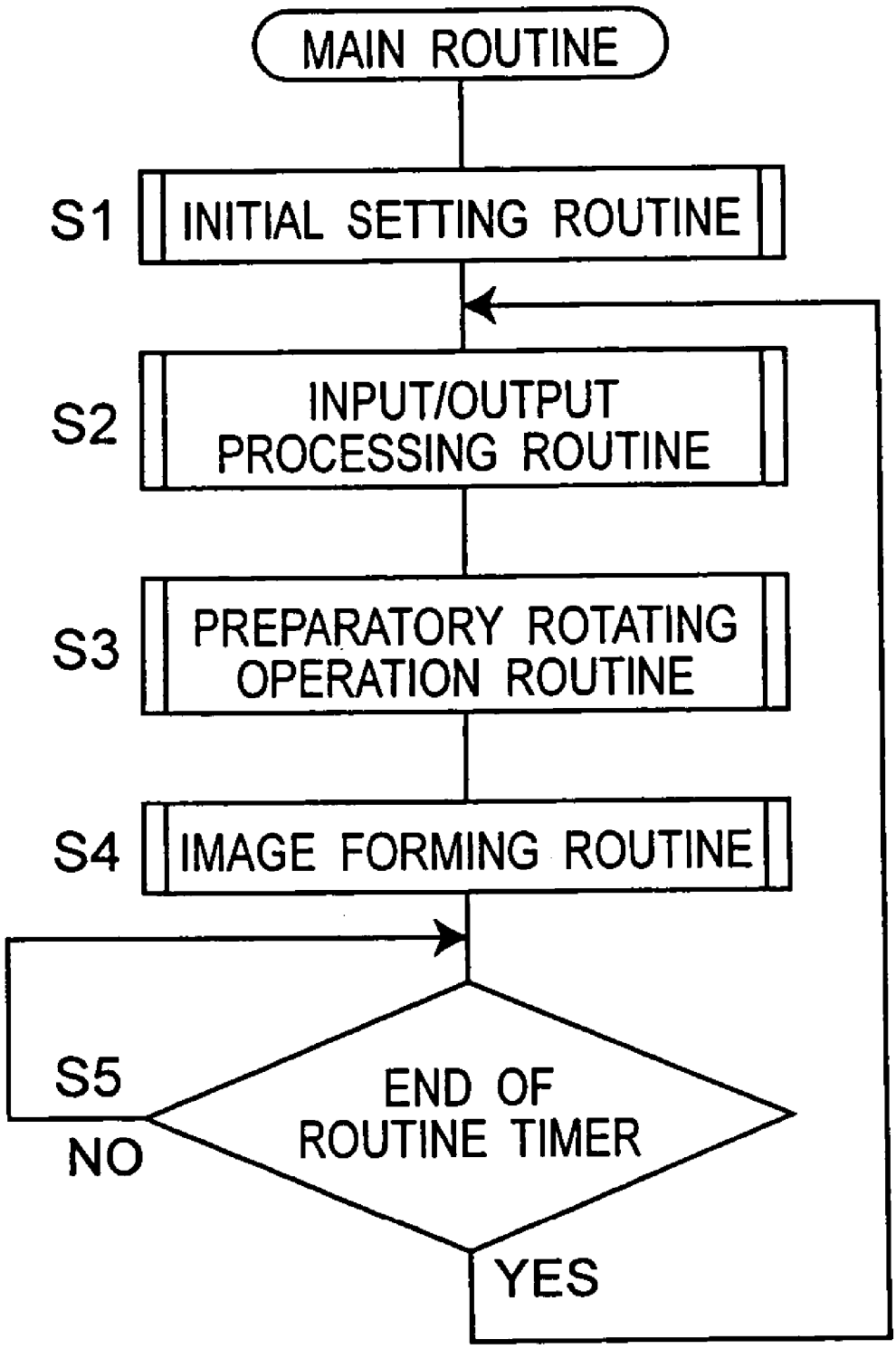
FIG. 4 is a flow chart showing a main routine executed in the control section.

FIG. 4 shows a flow chart of a main routine executed in the control section 60. The control section 60 executes, first, an initial setting routine for initializing time setting of preparatory rotating operation of the intermediate transfer belt 12 and each data (step S1), then, an input/output routine for storing temperature and time and for outputting a signal to each section in response to inputs from the outside, an operation panel and the like (step S2), a preparatory rotating operation routine for putting each section including the intermediate transfer belt 12 in a preparatory rotating operation (step S3), an image forming operation routine for driving each section so that they perform image forming operations (step S4), and finally, a processing for going back to the step S2 upon termination of a routine timer (step S5).

Figure 5:
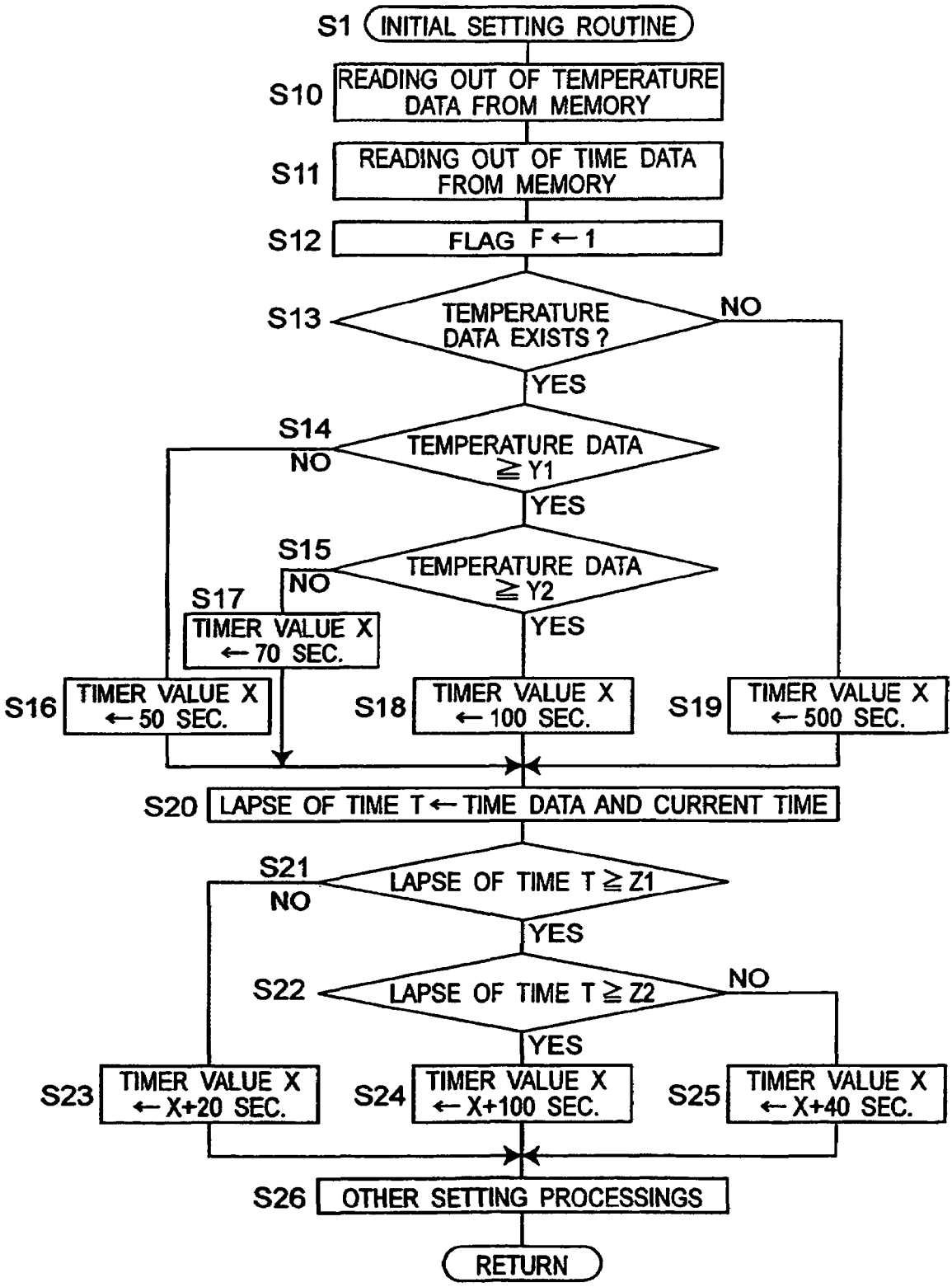
FIG. 5 is a flowchart showing an initial setting routine constituting part of the main routine.

Description will now be given of the initial setting routine in the step S1 with reference to the flowchart in FIG. 5.

In the initial setting routine, temperature data is first read out from the memory 65 (step S10). The temperature data is a temperature of the intermediate transfer belt 12 detected by a temperature sensor 62 and stored in the memory 65 when the main switch 72 is previously switched to power off the apparatus as described later. It is to be noted that the temperature data does not exist when the apparatus is powered on for the first time after delivery.

Then, time data is read out from the memory 65 (step S11). The time data is date and time obtained from the clock 61 and stored in the memory 65 when the main switch 72 is previously switched to power off the apparatus as described later.

Next, a flag F is set to "1" (step S12). The flag F is for determining whether or not the preparatory rotating operation is performed in-the preparatory rotating operation routine in the step S3 described later, and the flag F being set to "1" indicates that a timer value X of the internal timer 63 that defines preparatory rotating operation time is set.

Then, it is determined whether or not the temperature data exists (step S13), and if the temperature data does not exist, then the timer value X is set to 500 seconds (step S19), while if the temperature data exists, then the procedure proceeds to the next step S14.

It is noted that the timer value X is set to relatively long time as 500 seconds when the temperature data does not exist (i.e., the case where the apparatus is powered on for the first time after delivery). This is for fully recovering a creep deformation portion by performing the preparatory rotating operation for longer time because the apparatus is possibly exposed to a high-temperature state for a long period of time or over the long period while it is transported or stored after delivery and so a large creep deformation may be generated on the intermediate transfer belt 12.

In the step S14, it is determined whether or not the temperature data is equal to or above a specified temperature Y1 (e.g., 40° C. in this embodiment). The temperature of 40° C. herein refers to the temperature which may cause a creep deformation on the intermediate transfer belt 12, if the apparatus is held for a long period of time at this temperature or above. Based on this estimation, the timer value X is set to 50 seconds, that is preparatory rotating operation time in general stabilization control, if the temperature data is below the specified temperature Y1 (step S16), while the procedures proceeds to the step S15 if the temperature is equal to or above the specified temperature Y1.

In the step S15, it is determined whether or not the temperature data is equal to or above a specified temperature Y2 (e.g., 45° C. in this embodiment), and if it is below the specified temperature Y2, then the timer value X is set to 70 seconds (step S17), while if it is equal to or above the specified temperature Y2, then the timer value X is set to 100 seconds (step S18).

Next, by collating the time data that is date and time when the apparatus is previously powered off and present time that is date and time when the apparatus is powered on and that is obtained from the clock 61, a lapse of time T from power-off to repower-on of the apparatus is calculated (step S20).

After that, it is determined whether or not the lapse of time T is equal to or above predefined time Z1 (e.g., 8 hours in this embodiment) (Step S21), and if it is below the predefined time Z1, then 20 seconds are added to the timer value X (step S23), while if it is equal to or above the predefined time Z1, then the procedure proceeds to the next step S22.

In the step S22, it is determined whether or not the lapse of time T is equal to or above predefined time Z2 (e.g., 24 hours in this embodiment), and if it is below the predefined time Z2, then 40 seconds are added to the timer value X (step S25), while if it is equal to or above the predefined time Z2, then 100 seconds are added to the timer value X (step S24).

Finally, other initial setting processings are executed (step S26).

In the initial setting routine of the step S1 as described above, the timer value X, that is preparatory rotating operation time of the intermediate transfer belt 12, is set to be longer than preparatory rotating operation time in general stabilization control (50 sec.) if the temperature of the intermediate transfer belt 12 when the apparatus is previously powered off is equal to above the specified temperature Y1. Thus, in the case where the apparatus is powered off with the intermediate transfer belt 12 in a high-temperature state, a duration of time, during which the preparatory rotating operation of the intermediate transfer belt is performed when the apparatus is powered on next, is set to be longer than that in general stabilization control, so that a portion of the intermediate transfer belt 12 with a creep deformation in an arched state is recovered to its straightened state. Thereby, in the later-performed image forming operation, image noise attributed to the creep deformation of the intermediate transfer belt 12 can be prevented.

Further, in the initial setting routine in the step S1 as described above, corresponding to the detected temperature of the intermediate transfer belt 12 when the apparatus is powered off, the preparatory rotating operation time is changed, and also corresponding to a lapse of time from power-off to next power-on of the apparatus, the preparatory rotating operation time is changed. Thus, by setting the preparatory rotating operation time to be longer depending on the level of the creep deformation generated on the intermediate transfer belt 12, it becomes possible to fully recover a portion of the intermediate transfer belt 12 with the creep deformation.

Figure 6:
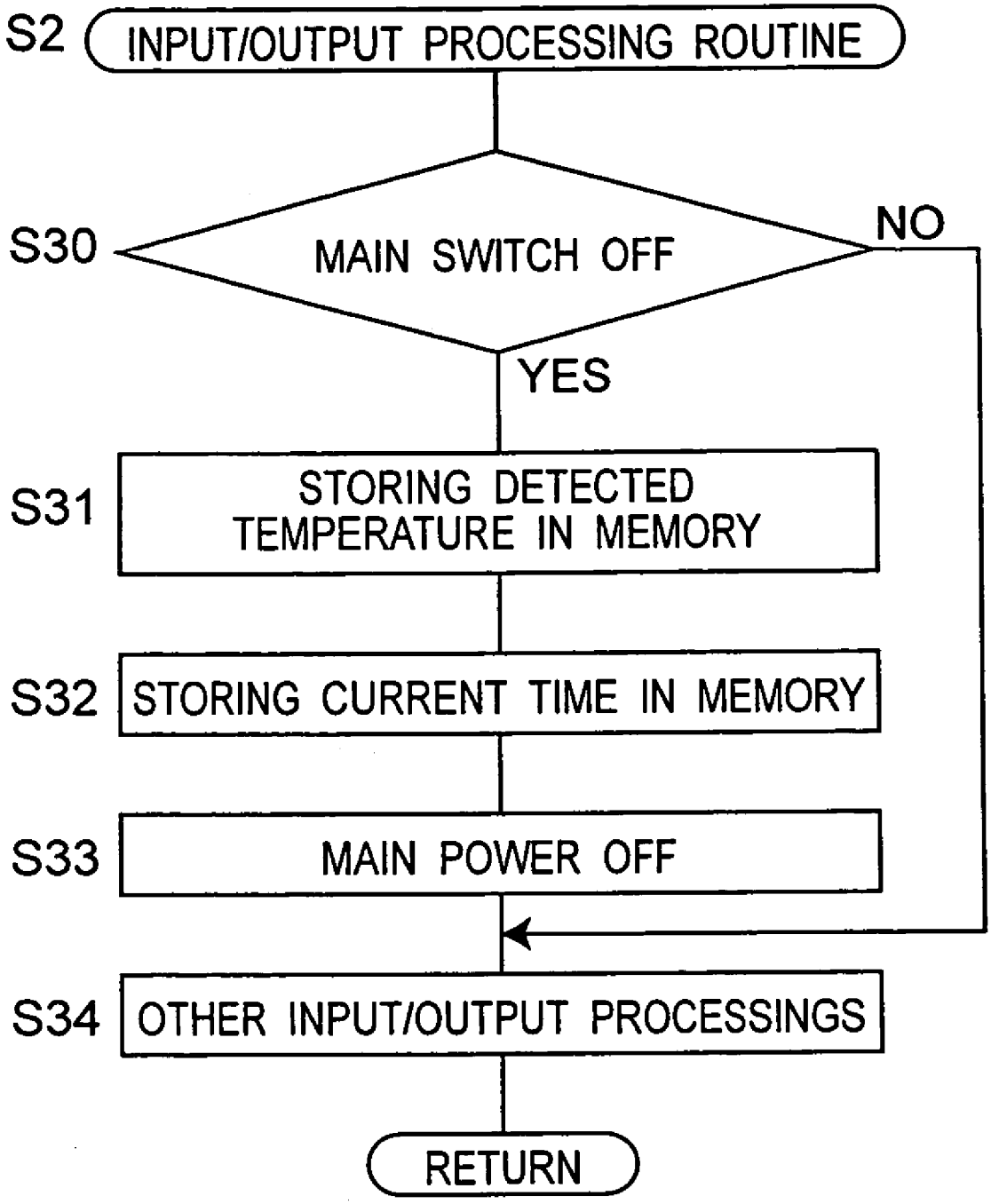
FIG. 6 is a flowchart showing an input/output processing routine constituting part of the main routine.

Description will now be given of the input/output processing routine in the step S2 with reference to a flowchart in FIG. 6.

First, it is determined whether or not the main switch 72 is switched off (step S30). If it is switched off, then a temperature of the intermediate transfer belt 12 detected by the temperature sensor 62 and current time are stored in the memory 65 (steps S31, S32). Thus, the temperature data and the time data when the apparatus is powered off are obtained. Then, a main power is turned off (step S33), and other input/output processings are performed (step S34). If it is determined in the step S30 that the main switch 72 is not switched off, then only other input/output processings are performed (step S34).

Figure 7:
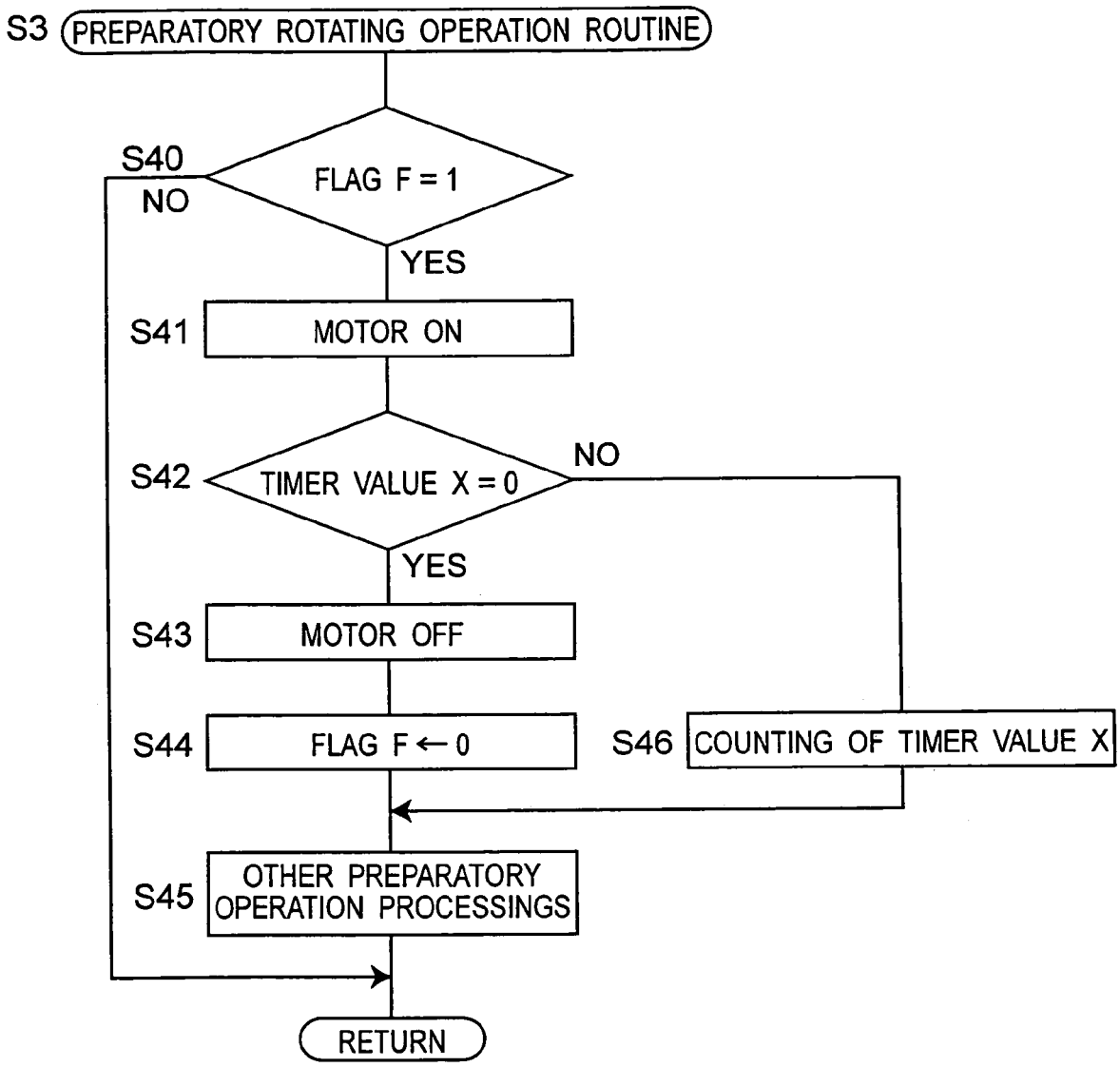
FIG. 7 is a flowchart showing preparatory rotating operation routine constituting part of the main routine.

Description will now be given of the preparatory rotating operation routine in the step S3 with reference to a flowchart in FIG. 7.

First, it is determined whether or not a flag F is "1" (step S40). If the flag F is not "1", then the procedure proceeds to Return. If the flag F is "1", then the main motor 64 is driven (step S41) to put the intermediate transfer belt 12 in a preparatory rotating operation. Next, it is determined whether or not the timer value X is "0" (step S42), and if it is not "0", then counting is started or continued so as to decrement the timer value X (step S46) and other preparatory operation processings are performed (step S45). When the timer value X reaches "0" by repeatedly executing the preparatory rotating operation routine as part of the main routine, the main motor 64 is stopped driving (step S43), the flag F is reset to "0" (step S44), and finally other preparatory operation processings are performed (step S45). Thus, the intermediate transfer belt 12 is put in a preparatory rotating operation for a period of time of value X set in the initial setting routine.

It is to be noted that the phenomenon that a creep deformation portion is recovered during the preparatory rotating operation of the intermediate transfer belt 12 generally becomes more noticeable as temperature rises, so that the temperature of the intermediate transfer belt 12 may be increased for reducing the preparatory operation time.

Further in the image forming apparatus 10 of the present embodiment, the temperature of the intermediate transfer belt 12 is directly detected by the intermediate transfer belt temperature sensor 62. However, the temperature of the intermediate transfer belt 12 may be detected indirectly from the temperature measured by a temperature sensor (detection section) provided to measure an environmental temperature inside the apparatus or temperatures of other members, or the temperature of the intermediate transfer belt 12 may be detected (estimated) indirectly from an image printing mode such as a two-side printing mode (wherein the control section 60 functions as a detection section).

Furthermore in the image forming apparatus 10 of the present embodiment, the movable member having flexibility is an intermediate transfer belt 12. However, the present invention is also applicable if the movable member having flexibility, which is in the state of being curved under the action of an external force when image forming is not operated in an inoperative state, is a fixing belt 44, electrically-charging members (such as electrically-charging brushes or electrically-charging rollers) or a developing roller, which are in press-contact with the surface of the photo conductor and allows rotative drive.

Furthermore, the present invention is also applicable to an image forming apparatus having a paper conveyer belt that has the same structure as the intermediate transfer belt 12 and rotates while holding paper on its surface as a flexible, movable member. In this type of image forming apparatuses, toner images of each color from each of the print units 24Y, 24M, 24C, 24K are respectively transferred onto a sheet of paper conveyed by the paper conveyer belt.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus for forming images on a recording medium, comprising:

a movable member having flexibility;

a detection section for detecting temperature of the movable member directly or indirectly;

a storage section for storing the temperature detected by the detection section when the apparatus is powered off; and a control section for changing a duration of time during which the movable member is in a preparatory operation corresponding to the detected temperature read from the storage section when the apparatus is powered on.

2. The image forming apparatus as defined in claim 1, wherein the control section puts the movable member in a preparatory operation for first predefined time when the detected temperature read from the storage section is below a specified temperature, and puts the movable member in a preparatory operation for second predefined time that is longer than the first predefined time when the detected temperature is equal to or above the specified temperature.

3. The image forming apparatus as defined in claim 2, wherein the control section puts the movable member in a preparatory operation for third predefined time that is longer than the second predefined time when the detected temperature does not exist in the storage section.

4. The image forming apparatus as defined in claim 1, wherein the control section further changes a duration of time during which the movable member is put in a preparatory operation according to a lapse of time from power-off to repower-on of the apparatus.

5. The image forming apparatus as defined in claim 4, wherein the lapse of time is obtained from a clock backed up with a battery by the control section.

6. The image forming apparatus as defined in claim 1, wherein the detection section detects the temperature of the movable member indirectly from an inside temperature of the apparatus.

7. The image forming apparatus as defined in claim 1, wherein the detection section detects the temperature of the movable member indirectly from an image printing mode.

8. The image forming apparatus as defined in claim 1, wherein the detection section detects the temperature of the image forming apparatus indirectly from a temperature of a member other than the movable member.

9. The image forming apparatus as defined in claim 1, wherein the movable member is an endless belt hung over at least two rollers.

10. The image forming apparatus as defined in claim 9, wherein the endless belt is an intermediate transfer belt.

11. The image forming apparatus as defined in claim 9, wherein the endless belt is a fixing belt.

12. The image forming apparatus as defined in claim 1, wherein the movable member is an electrically-charging member.

13. A method for controlling an image forming apparatus which includes a movable member having flexibility, comprising:

a step 1 for detecting a temperature of the movable member directly or indirectly when the image forming apparatus is powered off; and a step 2 for changing a duration of time during which the movable member is put in a preparatory operation when the image forming apparatus is powered on according to the temperature detected in the step 1.

14. The method as defined in claim 13, wherein in the step 2, the movable member is put in a preparatory operation for first predefined time when the detected temperature is below a specified temperature, and the movable member is put in a preparatory operation for second predefined time that is longer than the first predefined time when the detected temperature is equal to or above the specified temperature.

15. The method as defined in claim 14, wherein the step 1 further includes a step for storing data relating to the detected temperature in a storage section, and in the step 2, the movable member is put in a preparatory operation for third predefined time that is longer than the second predefined time when the data does not exist in the storage section.

16. The method as defined in claim 13, wherein further in the step 2, a duration of time during which the movable member is put in a preparatory operation is changed corresponding to a lapse of time from power-off to repower-on of the image forming apparatus.

17. The method as defined in claim 13, wherein the movable member is an endless belt hung over at least two rollers.

18. The method as defined in claim 17, wherein the endless belt is an intermediate transfer belt.

19. The method as defined in claim 17, wherein the endless belt is a fixing belt.

20. The method as defined in claim 13, wherein the movable member is an electrically-charging member.

* * * * *